US005382171A

United States Patent [19]

Hofmann et al.

[11] Patent Number: 5,382,171

[45] Date of Patent: Jan. 17, 1995

[54] ELECTRIC SOCKET ESPECIALLY FOR MOTOR VEHICLES

[75] Inventors: Dieter Hofmann, Aschaffenburg; Berthold Kalkus, Butzbach, both of Germany

[73] Assignees: Schoeller & Co.; Elektrotechnische Fabrik GmbH & Co., Frankfurt am Main, Germany

[21] Appl. No.: 98,534

[22] Filed: Jul. 28, 1993

[30] Foreign Application Priority Data

Aug. 4, 1992 [DE] Germany ..... 4225689

[51] Int. Cl.[6] ..... H01R 13/447

[52] U.S. Cl. ..... 439/142; 439/35

[58] Field of Search ..... 439/135, 136, 142, 35, 439/138

[56] References Cited

U.S. PATENT DOCUMENTS 4,342,493 8/1982 Grenell .

4,713,017 12/1987 Pesapane ..... 439/142

FOREIGN PATENT DOCUMENTS 0223022 5/1985 Germany ..... 439/136

*Primary Examiner*—Eugene F. Desmond

*Attorney, Agent, or Firm*—Anderson Kill Olick & Oshinsky

[57] ABSTRACT

The present invention is directed to an electrical plug-in socket, especially for motor vehicles, which has a hinged lid, a compression spring, for the hinged lid, a chamber for the compression spring molded to the socket housing, and a cam provided with a control curve and molded to the hinged lid. The cam cooperates in such a way with the compression spring, that the hinged lid is automatically held in one of the closed and the open position. In order to simplify the assembly or installation of the hinged lid and in order to lower the material and installation costs, the compression spring is designed as a leaf spring and is molded into the chamber of the plug-in socket housing. The leaf spring has a spherical section-shaped rise for the control curve of the cam.

4 Claims, 2 Drawing Sheets

ELECTRIC SOCKET ESPECIALLY FOR MOTOR VEHICLES

FIELD OF THE INVENTION

The present invention deals with an electric socket or power outlet, in particular, for motor vehicles, which has a hinged lid or cover, a compression spring for the hinged lid or cover, a chamber which is molded to the plug-in socket housing for the compression spring, and a cam which is molded to the hinged lid and which is provided with a control curve which can cooperate in such a way with the compression spring that the hinged lid is held automatically in the closed position or in the open position.

BACKGROUND OF THE INVENTION

Such a plug-in socket is known from DE-GM 75 12 017. In the known socket, a helical spring, serving as a compression spring with a locking or latching member which has a spherical segment-shaped head, is disposed in a sleeve provided with a bottom or base and molded to the plug-in socket covering. The blocking or locking member cooperates with a cam forming a control curve which cam is molded to the hinged lid. The helical spring and the locking member are separate components which must be inserted into the sleeve of the socket covering prior to placing the hinged lid upon the plug-in socket covering. The installation of the hinged lid is thus cumbersome and expensive.

SUMMARY OF THE PRESENT INVENTION

It is an object of the present invention to simplify the installation of the hinged lid in order to lower the material, fabrication, and installation costs. This is achieved by the present invention in an advantageous manner in that the compression spring is configured as a leaf spring and is molded into the chamber of the socket housing as well as comprising a spherical section shaped rise or elevation for the control curve of the cam.

The plug-in socket housing, the chamber for receiving the leaf spring, and the leaf spring, constitute one single component which can be fabricated from plastics by injection molding. This has the advantage of enabling an economical fabrication of the socket together with the hinged lid.

Accordingly, it is an object of the present invention to provide an electric socket, especially for motor vehicles, which simplifies the installation of the hinged lid in order to lower the material, fabrication and installation costs.

It is another object of the present invention to provide an electric socket, especially for motor vehicles, which provides the advantage of enabling economical fabrication of the socket together with the hinged lid.

Other objects and advantages of the present invention will be apparent to those persons skilled in the art upon a review of the Description of the Preferred Embodiment taken in conjunction with the Drawings which follow.

DETAILED DESCRIPTION OF THE PREFERRED EMBODIMENT

Figure 1:
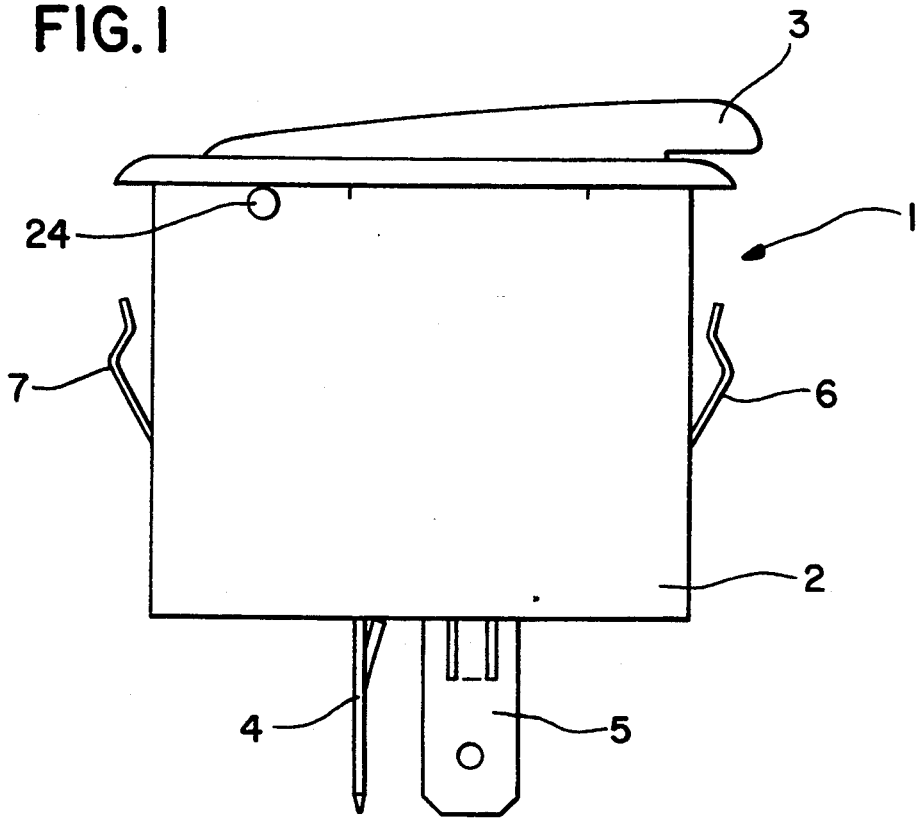
FIG. 1 illustrates a side view of the plug-in socket together with the hinged lid.
Figure 2:
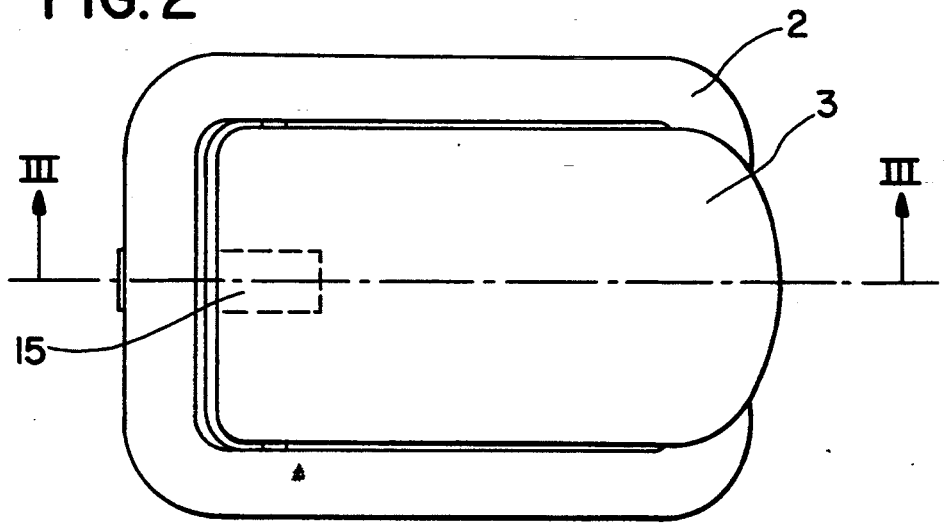
FIG. 2 illustrates a plan view upon the socket of FIG. 1.

With reference to FIGS. 1 and 2, the socket 1 consists of a housing 2 with a hinged lid or cover 3 and two flat terminals 4 and 5 for connection to the electrical energy supply. In order to clamp the socket in the dashboard of a motor vehicle, clamping springs 6 and 7 are provided on the front and rear sides of the housing 2. A cylindrical chamber, for receiving the instrument or appliance plug, and a chamber 9, for the leaf spring 10, are located inside the housing 2, which leaf spring is provided with a spherical section or wart-shaped rise 11.

Figure 3:
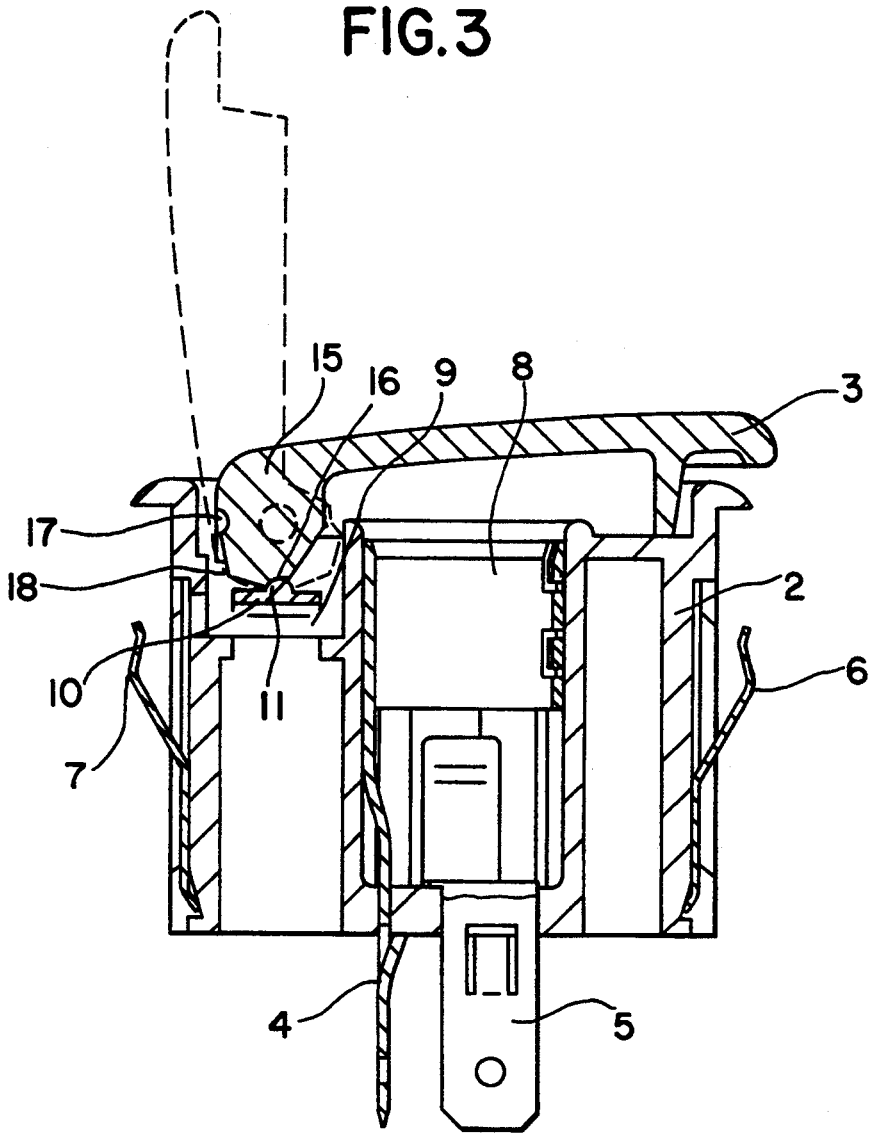
FIG. 3 illustrates a section through the socket along the lines III—III in FIG. 2 wherein the open hinged lid has been shown in broken lines.

With reference to FIG. 3, the leaf spring 10 runs perpendicularly to the plane of the drawing in FIG. 3 and forms one single component with the plastics housing and is injected into the housing in the course of the injection molding process. A cam 15, which is molded to the lid 3, is located on the rear side of the hinged lid 3, which is equipped with a control curve cooperating with the rise 11 on the leaf spring 10. Two spherical depressions 16 and 17 are disposed in the cam 15 into which the rise 11 snaps in the closed or open position of the hinged lid 3. An edge 18, upon the control curve, subdivides same into two curved pieces, one for the automatic closing motion of the hinged lid and the other for the automatic opening motion when the hinged lid is manually pressed out of the respective detented or snapped-in position, this until the rise 11 reaches the edge 18.

Figure 4:
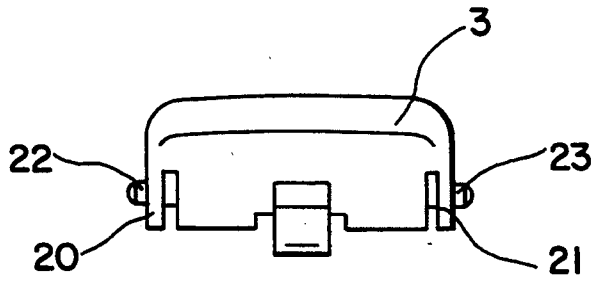
FIG. 4 illustrates a rear view upon the hinged lid.

As FIG. 4 illustrates, two elastic legs 20 and 21, with support or bearing lugs 22 and 23, are attached to the hinged lid 3, which snap into bores 24 in the plug-in socket housing 2 upon installation of the hinged lid.

While the present invention has been described in a preferred embodiment, such description is merely illustrative of the present invention and is not to be construed as a limitation thereof. In this regard, the present invention is meant to encompass all modifications, variations and/or alternate embodiments with the scope of the present invention limited only by the claims which follow.

What is claimed is:

1. An electric plug-in socket, especially for motor vehicles, comprising:

a housing;

a hinged-lid, wherein said hinged-lid is connected to said housing;

a chamber, wherein said chamber is formed in said housing;

a spring device, wherein said spring device has a spherical section formed integrally thereon, wherein said spring device is used in conjunction with said hinged-lid, and further wherein said spring device is formed integrally with said housing, and further wherein said spring device is located in a spring device chamber which is formed in said housing; and a cam device, wherein said cam device is formed integrally with said hinged-lid, and wherein said cam device is provided with a control curve which is utilized in conjunction with said spring device, wherein said hinged-lid is automatically held in one of a closed position and an open position.

2. The electric plug-in socket of claim 1, wherein said control curve has two depressions formed therein, and wherein said spherical section of said spring device is utilized in conjunction with at least one of said two depressions in order to support said hinged-lid in at least one of an open and a closed position.

3. The electric plug-in socket of claim 1, wherein said cam comprises:

an edge in a length of said control curve for changing one of a closing motion of said hinged-lid into an opening motion of said hinged-lid and an opening motion of said hinged-lid into a closing motion of said hinged-lid.

4. The electric plug-in socket of claim 2, wherein said cam comprises:

an edge in a length of said control curve for changing one of a closing motion of said hinged-lid into an opening motion of said hinged-lid and an opening motion of said hinged-lid into a closing motion of said hinged-lid.

* * * * *